US006197157B1

(12) United States Patent
Hasenfuss et al.

(10) Patent No.: US 6,197,157 B1
(45) **Date of Patent: *Mar. 6, 2001**

(54) PROCESS FOR DRAINING OR SMOOTHING A FIBROUS PULP WEB

(75) Inventors: Rudolf Hasenfuss, Herbrechtingen; Joachim Grabscheid, Heuchlingen; Christian Schiel, Murnau; Wolfgang Schuwerk, Kiesslegg, all of (DE)

(73) Assignee: Voith Sulzer Papermaschinen GmbH, Heidenheim (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/022,549

(22) Filed: Feb. 12, 1998

(30) Foreign Application Priority Data

Feb. 12, 1997 (DE) ..... 197 05 360

(51) Int. Cl.[7] ..... D01F 3/04

(52) U.S. Cl. ..... 162/205; 210/358.1; 210/358.3; 210/360.2

(58) Field of Search ..... 162/360.3, 360.2, 162/358.1, 358.3, 361, 198

(56) References Cited

U.S. PATENT DOCUMENTS

| | | | | |
|---|---|---|---|---|
| 4,976,821 | | 12/1990 | Laapotti . | |
| 5,167,768 | * | 12/1992 | Cronin et al. | 162/205 |
| 5,389,205 | | 2/1995 | Pajula et al. . | |
| 5,441,604 | * | 8/1995 | Sandberg et al. | 162/358.3 |
| 5,522,959 | | 6/1996 | Ilmarinen . | |
| 5,582,689 | * | 12/1996 | Van Haag et al. | 162/358.3 |
| 5,611,893 | | 3/1997 | Pajula et al. . | |
| 5,639,351 | | 6/1997 | Ilmarinen . | |
| 5,650,049 | * | 7/1997 | Klvimaa et al. | 162/360.2 |
| 5,705,034 | * | 1/1998 | Schiel | 162/360.3 |
| 5,833,810 | * | 11/1998 | Laapotti | 162/360.3 |

FOREIGN PATENT DOCUMENTS

| | | |
|---|---|---|
| 3515576 | 11/1985 | (DE) . |
| 487483 | 5/1992 | (EP) . |
| 549553 | 6/1993 | (EP) . |

OTHER PUBLICATIONS

Copy of a Search Report for German Application No. 197 05 360.2, filed Feb. 12, 1997.

Schuwerk, Wolfgang, "Schuhpressen fur grafische Papiere—Konzepte und erste Betriebserfahrungen", *Das Papier*, H. 10A, 1995, S. V106–V115.

* cited by examiner

*Primary Examiner*—Dean T. Nguyen
(74) *Attorney, Agent, or Firm*—Greenblum & Bernstein, P.L.C.

(57) ABSTRACT

A press device for draining and/or smoothing, or shaping the surface and controlling the sheet structure of fibrous pulp webs with a surface weight of under 100 g/m$^2$, such as the fibrous pulp webs used to make graphic papers. The device has a press area which includes at least one press nip through which, during operation, the fibrous pulp web is fed at a velocity of at least 1200 m/min, under simultaneous impingement by pressure. The press area includes at least two press zones subsequent to one another. The device is further characterized by a K value of at least 2.5 kPa·s·m. This K value is the product of $L_1$ and $I_{tot}$. $L_1$ is the length of the first press zone, measured along the direction in which the web runs, and $I_{tot}$ is the total press impulse operating on the fibrous pulp web in the entire press area.

30 Claims, 3 Drawing Sheets

PROCESS FOR DRAINING OR SMOOTHING A FIBROUS PULP WEB

CROSS REFERENCE TO RELATED APPLICATION

This application is related to, and claims priority under 35 U.S.C. § 119 of, German Application No. 197 05 360.2, filed Feb. 12, 1997, the disclosure of which is expressly incorporated herein in its entirety by reference thereto.

BACKGROUND OF THE INVENTION

1. Field of the Invention

The present invention relates to a device and a process, particularly a press device and a pressing process. The device and process of the invention are for use on a fibrous web or fibrous pulp web, such as a cellulosic fibrous web or cellulosic fibrous pulp web, having a surface weight of about 100 g/m$^2$ or less, or under about 100 g/m$^2$; graphic papers are particularly preferred. The device and process of the invention are utilized for treating—e.g., for draining (particularly dewatering) and/or for smoothing—and particularly for pressing the indicated material, and for controlling its surface properties and sheet structure.

The device and process of the invention employ a press area which comprises or consists of at least one press nip. During operation of the device and practice of the process, the fibrous pulp web is fed through the press area at a speed of at least about 1200 m/min, while simultaneously being subjected to pressure.

2. Discussion of Background Information

Press devices of the type as discussed above, for the production of high-grade, graphic papers, usually are composed of compact presses, comprising or consisting of a press with 3 or 4 rolls, followed by at least one supplementary laying press. Such a relatively large number of essential roll openings, which is necessary due to the high operating velocity used in producing high-grade graphic papers, results in a large space requirement for these devices, because of the correspondingly large number of rolls needed. Despite this relatively high expenditure, only a limited draining capacity is attained because of the high operating velocity.

SUMMARY OF THE INVENTION

It is accordingly an object of the present invention to provide a press device and a pressing process of the type as mentioned initially above, but which have as small a space requirement as possible, while at the same time both displaying a high capacity for draining at high operational speeds, and also avoiding a loss of quality, such as from crumpling the paper web. This object is achieved by providing that the press area of the indicated press device and pressing process comprises at least two press zones in succession, and also providing that the device and process attain a K value of at least 2.5 kPa·s·m, or at least about 2.5 kPa·s·m. Preferably, the device and process of the invention attain a K value of at least 2.6 kPa·s·m, or at least about 2.6 kPa·s·m, or at least 2.8 kPa·s·m, or at least about 2.8 kPa·s·m, or at least 3.0 kPa·s·m, or at least about 3.0 kPa·s·m.

The indicated K value is the product of $L_1$ and $I_{tot}$. $L_1$ is the length of the first press zone, measured along the direction in which the web runs, and $I_{tot}$ is the total press impulse operating on the fibrous pulp web in the entire press area.

With press devices of the prior art, usually the fibrous pulp web is first drained intensively with roll presses, with a high line force, and then drained gently with extended nip presses. Pressure peaks with large gradients accordingly appear at high velocities. As a result, large quantities of water are pressed out of the loosely bound, wet paper web in a short amount of time, so that the paper web can be damaged, for example by crumpling.

However, for the present invention, it is guaranteed that a sufficient pressing time in the first press zone, as well as a sufficient press impulse for as high a draining or dewatering capacity as possible, are provided for the fibrous pulp web. If the draining or dewatering is not gentle, then twosidedness increases; however, the use of gentle draining or dewatering has the desirable effect of minimizing twosidedness. A gentle draining or dewatering is achieved by means of the length of the first press zone as well as the total press impulse operating on the fibrous pulp web.

It is understood that twosidedness, with reference to a particular property or properties, pertains to a variation in that property or properties between the top side and the bottom side of the fibrous web, for example, paper or liner. If the difference between the top and the bottom side is small for a particular property, then twosidedness for that property is small.

For instance, twosidedness in ash content refers to a difference in ash content distribution, from the top to the bottom of the web or paper product; correspondingly, minimizing twosidedness in ash content means minimizing the difference in ash content distribution between the top side and the bottom side. Accordingly, twosidedness in filler content refers to a difference in filler content distribution, from the top to the bottom of the web or paper product; correspondingly, minimizing twosidedness in filler content means minimizing the difference in ash content distribution between top and bottom.

There is also twosidedness with respect to the properties of structure and roughness. Minimizing structural twosidedness means minimizing the difference in the structural arrangement of fibers between the top and bottom sides. Minimizing twosidedness as to roughness means minimizing the difference between the roughness of the surface of the top side and the roughness of the surface of the bottom side.

As indicated herein, gentle dewatering minimizes twosidedness generally. Among the specific properties for which gentle draining diminishes twosidedness are structural twosidedness, twosidedness in ash content, twosidedness in filler content, and twosidedness as to roughness.

Because the amount of fluid is highest at the point where the fibrous pulp web is fed into the press device, or where the fibrous pulp web is first subjected to the pressing process, significantly more fluid must be diverted at the beginning of the pressing than at the end of the pressing. Therefore, a gentle draining in the first press zone is especially important at the machine velocities which are necessary for treating graphic papers. Because of the length of the first press zone in accordance with the invention, and accordingly the extent of the time period during which the fibrous pulp web is inside this zone, the essential gentle draining is accomplished in the first press zone.

The pressure pries of the various press zones can be the same, or substantially or essentially the same. However, it is advantageous for various press zones to have differing pressure profiles. For example, after the first, gentle draining in the first press zone, there can follow a gentle draining in the second press zone, with the pressure profile of this second zone demonstrating a pressure gradient larger than that of the pressure profile of the first press zone.

In a preferred and advantageous embodiment of the invention, the press zones of the press area are formed by several presses, such as shoe presses, roll presses, and extended nip presses. Preferably a shoe press is used to form the first press zone, because the distinguishing features of the invention can be especially easily attained with a shoe press. Thus it is especially simple to adjust the essential, gentle draining in the first zone by means of a shoe press. The reason for this ease of adjust is that, on the one hand, long duration of the web in the zone, and on the other hand, a moderate increase in pressure via a corresponding length and shape of the press shoe as well as a corresponding impingement of the press shoe, can be achieved with pressure.

The present invention may employ two or two or more press zones, or three or three or more press zones. Assuming that the first press zone is formed by a shoe press or a part of a shoe press, the most diverse embodiments of the remaining press zones are conceivable. For example, the entire press area can encompass two press zones, whereby the first press zone is formed by a shoe press and the second press zone by a roll press or another shoe press. As another example, the press area can also comprise three press zones, whereby the first press zone is formed by a shoe press, and the second and third press zones by roll presses which successively follow the shoe press along the path of the web. In place of the second roll press, another shoe press can be provided.

As another possible embodiment, there may be at least two successive press zones formed by shoe presses which are arranged alternatively—specifically, situated on different, or opposite, sides of the fibrous pulp web, or of the path along which the web runs. The shoe presses may be configured so that in successive zones, pressure is alternatingly applied to opposite sides of the web.

To further reduce the amount of space required, the press area can comprise or consist of only two press zones, which are both formed by shoe presses arranged successively in the direction that the web runs. Preferably in this embodiment, the two shoe presses are equal, or at least substantially or essentially equal; specifically, they are preferably of the same, or at least substantially or essentially the same, mechanical configuration or design. In order to attain a final, intense draining at the end of the pressing, yet another roll press can be provided after both shoe presses in the direction that the fibrous pulp web runs.

As one embodiment of the invention, where the press area consists of only two press zones and the two zones are formed by successive shoe presses as indicated, and particularly where the two shoe presses are of the same, or at least substantially or essentially the same, mechanical configuration or design, the line forces $\bar{p}_1$ and $\bar{p}_2$ of the two press zones are equal, or at least substantially or essentially equal, but the lengths $L_{1S}$ and $L_{2S}$ of the press zones—i.e., the lengths of the shoes—as measured along the direction in which the web runs, are not equal. In other words, the running conditions of the two shoe presses are equal, or at least substantially or essentially equal, but the shoe designs are not equal.

As another embodiment of the invention, where the press area consists of only two press zones and the two zones are formed by successive shoe presses as indicated, and particularly where the two shoe presses are of the same, or at least substantially or essentially the same, mechanical configuration or design, the line forces $\bar{p}_1$ and $\bar{p}_2$ of the two press zones are not equal, but the lengths $L_{1S}$ and $L_{2S}$ of the press zones—i.e., the length of the shoes—as measured along the direction in which the web runs, are equal, or at least substantially or essentially equal. In other words, the running conditions of the two shoe presses are not equal, but the shoe designs are equal, or at least substantially or essentially equal.

As yet another embodiment of the invention, where the press area consists of only two press zones and the two zones are formed by successive shoe presses as indicated, and particularly where the two shoe presses are of the same, or at least substantially or essentially the same, mechanical configuration or design, the line forces $\bar{p}_1$ and $\bar{p}_2$ of the two press zones are not equal, and likewise the lengths $L_{1S}$ and $L_{2S}$ of the press zones—i.e., the lengths of the shoes—as measured along the direction in which the web runs, are not equal. In other words, both the running conditions of the two shoe presses, and the shoe designs, are not equal.

As still a further embodiment of the invention, where the press area consists of only two press zones and the two zones are formed by successive shoe presses as indicated, and particularly where the two shoe presses are of the same, or at least substantially or essentially the same, mechanical configuration or design, the line forces $\bar{p}_1$ and $\bar{p}_2$ of the two press zones are equal, or at least substantially or essentially equal, and also the lengths $L_{1S}$ and $L_{2S}$ of the press zones—i.e., the length of the shoes—as measured along the direction in which the web runs, are equal, or at least substantially or essentially equal. In other words, the running conditions of the two shoe presses are equal, or at least substantially or essentially equal, and also the shoe designs are equal, or at least substantially or essentially equal.

With regard to the foregoing, press zone line force $\bar{p}$ is defined by the area encompassed by the pressure profile. It is also defined by the equation $$\bar{p} = \int_L p\,dx$$

As discussed herein, in the present invention the individual press zones can be provided by different press mechanisms. However, it is also within the scope of the invention for the press area to be formed by a single press mechanism. This single press mechanism can be a long shoe press or an extended nip press, with a press area which is elongated in the direction that the fibrous pulp web runs. The press area, accordingly having a long configuration, is thereby separated into at least two successive press zones, and the necessary press dimensions can be adjusted therein.

With regard to the use of a long so press as the single press mechanism, it is noted that in the present state of the art, the maximum shoe length for a conventionally sized shoe press is about 300 mm. In the context of the present invention, it is understood that a long shoe press is one having a length of more than about 300 mm, as measured along the direction in which the web runs. An example of a long shoe press is one having a length of 500 mm, or about 500 mm.

In the present invention, the fibrous pulp web is preferably run at a velocity of at least 1200 m/min, or at least about 1200 m/min. In an advantageous embodiment of the invention, the transport velocity of this web is more preferably at least 1500 m/min, or at least about 1500 m/min. As a matter of particular preference, the velocity of the fibrous pulp web is at least 1800 m/min, or at least about 1800 m/min. It is also within the scope of the invention to run the fibrous pulp web at a velocity of at least 2500 m/min, or at least about 2500 m/min.

The value K, as discussed herein, is the product of the length $L_1$ of the first press zone, as measured in the direction that the fibrous pulp web runs, and of the total press impulse $I_{tot}$ in the entire press area affecting the fibrous pulp web. K is defined by the equation $$K = L_1 \cdot I_{tot} = L_1 \cdot \frac{\sum_{i=1}^{n} (p_{m_i} \cdot L_i)}{v} = t_1 \cdot \sum_{i=1}^{n} \overline{p}_i$$

wherein:

n=the number of press zones;

$L_i$=the length of the i-th press zone;

$p_{m_i}$=the medium pressure applied to the fibrous pulp web in the i-th press zone;

v=the velocity of the fibrous pulp web;

$t_1$=the time that a point of the fibrous pulp web resides in the first press zone; and $\overline{p}_i$=the line force applied to the fibrous pulp web in the i-th press zone.

In other words, for a press device and a pressing process of the present invention, the product, of the time $t_1$ that a point of the fibrous pulp web resides in the first press zone, and of the sum of the line forces $\overline{p}_i$ applied to the fibrous pulp web in the isolated press zones, amounts to at least about 2.5 kPa·s·m.

Preferably, the total length $$L_{tot} = \sum_{i=1}^{n}$$

$L_i$ of the press area is at least about 250 mm. Also as a matter of preference, the total time $$t_{tot} = \sum_{i=1}^{n}$$

$t_i$ that a point of the fibrous pulp web resides in the press area is at least about 10 milliseconds.

The total line force operating in the press area $$\overline{p}_{tot} = \sum_{i=1}^{n} \overline{p}_i$$

is preferably about 1800 kN/m or less. Also the total press impulse $I_{tot}$ operating on the fibrous pulp web is preferably at least about 25 kPa·s.

Yet additionally as a matter of preference, the characteristic number for the a draining capacity $DC=\overline{p}_{tot} \cdot t_{tot}$ is at least about 15

$$\frac{kN \cdot s}{m}.$$

And still further as a matter of preference, the characteristic number for gentle draining $$GD = \frac{\overline{p}_{tot}}{t_{tot}}$$

is about 63

$$\frac{MN}{m \cdot s}$$

or less.

The pressure applied to the fibrous pulp web in the first press zone is preferably lower than that employed in the one or more subsequent press zones. In this way, the essential, gentle draining can be advantageously achieved in the first press zone.

For the portions of the pressure profiles which indicate increasing pressure, the pressure profile in the first press zone can have a pressure gradient smaller than the pressure gradient of at least one of the one or more subsequent press zones. It is also due to this feature that the indicated gentle draining is taken into consideration in the first press zone.

BRIEF DESCRIPTION OF THE DRAWINGS

The present invention is further described in the detailed description which follows, in reference to the noted plurality of drawings by way of nonlimiting examples of preferred embodiments of the present invention, and wherein.

DETAILED DESCRIPTION OF THE PREFERRED EMBODIMENTS

Figure 1:
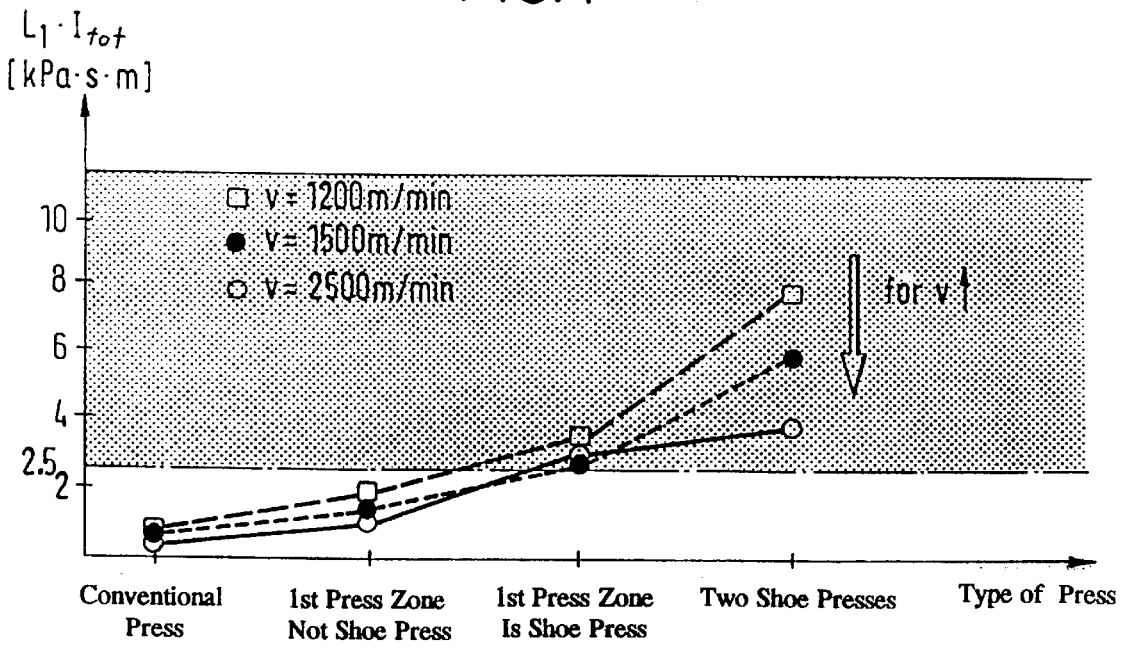
FIG. 1 is a graph showing different values for $L_1 \cdot I_{tot}$, obtained with different press devices at three different web velocities.

FIG. 1 shows the different $K=L_1 \cdot I_{tot}$ values, measured as kPa·s·m, obtained with different press devices, at different web velocities. The different press devices are a conventional press consisting of three roll presses, a press consisting of two roll presses and a subsequent shoe press, a press consisting of a shoe press with two subsequent roll presses, and a press consisting of two shoe presses in succession.

For each of these four press devices, kPa·s·m measurements are calculated for web velocities of 1200 m/min, 1500 m/min, and 2500 m/min.

For the first, second, and third press zones in the press devices, medium pressures of $p_{m1}$=2 MPa, $p_{m2}$=3 MPa, and $p_{m3}$=5 MPa, respectively, were chosen. The lengths of the press zones which were formed by roll presses were $L_1$=40 mm, $L_2$=30 mm, and $L_3$=30 mm, with the subscript denoting the position of that press zone within the press area, in relation to the other press zones. In this regard, a press area is formed by its successive press zones, with each press zone defined by the area in which its respective press operates; particularly, when the presses are press rolls, the press area is formed by the successive press rolls.

For the press devices with shoe presses, $L_{1S}$=150 mm, and $L_{2S}$=270 mm were chosen for the lengths of the press zones defined by their respective press shoes. Corresponding to the subscripts used for the roll presses, as discussed above, for these shoe presses the position of the press zone within the press area is likewise denoted by a supplementary subscript 1, 2, or 3.

The four following configurations were thusly obtained. The corresponding values for these configurations are shown.

1. Conventional Press (Press Zones $L_1$, $L_2$, $L_3$)

For a web velocity of V=1200 m/min, the result is $$K = L_1 \cdot I_{tot} = L_1 \cdot \frac{\sum_{i=1}^{n} (p_{m_i} \cdot L_i)}{v} = 40\,\text{mm} \cdot \frac{2MPa \cdot 40\,\text{mm} + 3MPa \cdot 30\,\text{mm} + 5MPa \cdot 30\,\text{mm}}{1200\,\text{m/min}} = 0.64kPa \cdot s \cdot m.$$

Correspondingly, for web velocities of V=1500 m/min and V=2500 m/min, the results are K=0.512 kPa·s·m and K=0.307 kPa·s·m, respectively.

With this press device, K values below the desired 2.5 kPa·s·m lower limit were obtained at web velocities of 1200 m/min and greater. It is accordingly evident that a conventional press device is not suitable for producing qualitatively high-grade, graphic papers at high operating velocities.

2. Press Device with Shoe Press Providing the Third Press Zone (Press Zones $L_1$, $L_2$, $L_{3S}$)

For this press device, values of $$\overline{p}_L = 800\frac{kN}{m},$$

$p_m$=3 MPa, and V=1200 m/min result in a K value ($K=L_1 \cdot I_{tot}$) of 1.96 kPa·s·m. Web velocities of V=1500 m/min and V 2500 m/min result in K values of 1.57 kPa·s·m and 0.94 kPa·s·m, respectively. Accordingly, for this device also the K values are below the desired value of 2.5 kPa·s·m, and therefore beneath the area in FIG. 1 shaded in grey.

Became the shoe press is not used for the first press zone in this press device, the essential, gentle draining is not attained at the beginning of the pressing. Therefore, with this press device, treatment of graphic papers at the necessary high velocities does not provide the desired quality.

3. Press Device with Shoe Press Providing the First Press Zone (press zones $L_{1S}$, $L_2$, $L_3$)

This press device, with a shoe press providing the first press zone, yields a K value ($K=L_{1S} \cdot I_{tot}$) of 3.225 kPa·s·m for $$\overline{p}_{L_1} = 200\frac{kN}{m},$$

$p_{m1}$=1.33 MPa, and V=1200 m/min. With a web velocity of V=1500 m/min, the resulting K value is 2.58 kPa·s·m. For $$\overline{p}_{L_1} = 292.6\frac{kN}{m},$$

$p_{m1}$=1.33 MPa, and V=2500 m/min, K=2.76 kPa·s·m.

Thus, the K values for this press device are greater than the desired 2.5 kPa·s·m lower limit, and therefore within the area shaded in grey in FIG. 1. Accordingly, with this configuration, a treatment of graphic papers at high velocities provides a treated paper web of high grade.

4. Press Device Consisting of Two Shoe Presses in Succession (Press Zones $L_{1S}$, $L_{2S}$)

With this press device, which comprises only two press zones, a pressure of 1.33 MPa was used as a basis for data in the first press zone, and a pressure of 3 MPa was used as a basis for data in the second press zone. Thereby, at a web velocity of V=1200 m/min, the resulting K value ($K=L_{1S} \cdot I_{tot}$) is 7.5 kPa·s·m; at V=1500 m/min and V=2500 m/min, the resulting K values are 6.0 kPa·s·m and 3.6 kPa·s·m, respectively.

It can accordingly be seen that through the application of two shoe presses in succession, the crucial lower limit of 2.5 kPa·s·m for the K value is thus in part markedly exceeded, as shown in FIG. 1.

Figure 2:
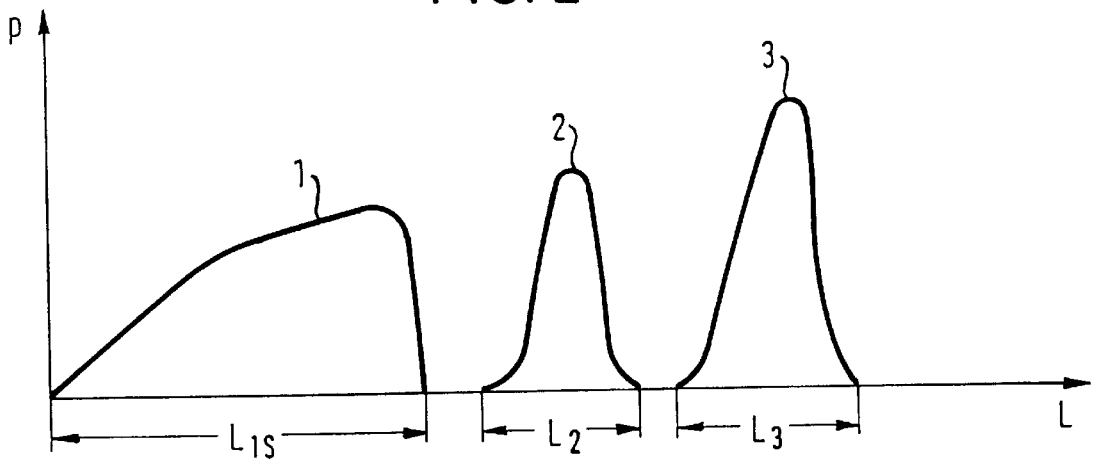
FIG. 2 is a graph showing the pressure profile, over the length of the press area, for a press device having a shoe press followed by two successive or connecting roll presses.

The gentle increase in pressure occurring at the beginning of the pressing in a shoe press is distinctly recognizable in the course of pressing 1, as shown in FIG. 2. Therein is depicted the pressure profile of a press device in accordance with the invention; specifically, this press device has a shoe press for forming the first press zone, followed by two successive or connecting roll presses, which form the second and third press zones, respectively. The gentle draining of the fibrous pulp web, initiated within the first press zone, ceases after distance $L_1$, at the end of the shoe press. The remainder of the draining thereafter occurs in the two following press zones. These zones are formed by roll presses of lengths $L_2$ and $L_3$, respectively, under impingement by high pressure and larger pressure gradients.

Figure 3:
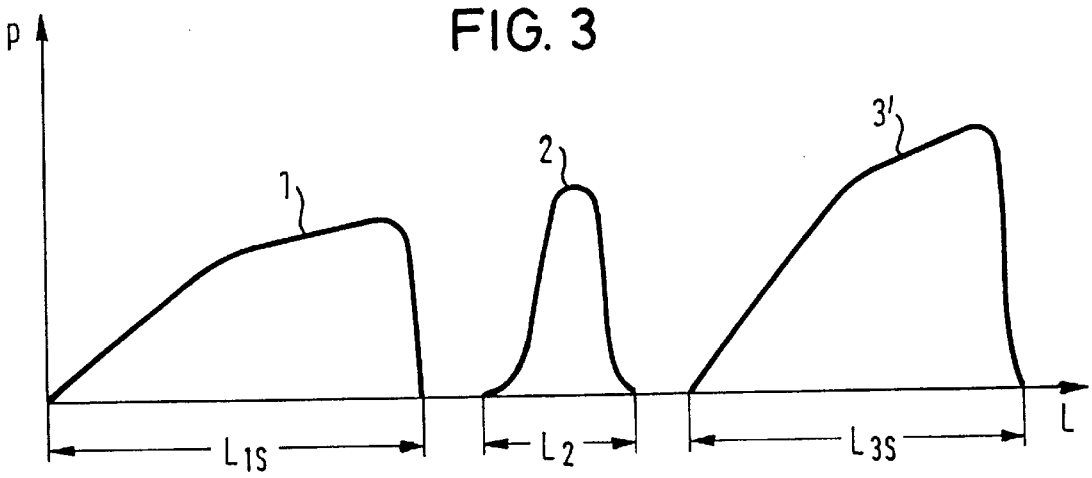
FIG. 3 is a graph showing the pressure profile, over the length of the press area, for a press device having a shoe press, followed by a roll press, followed by another shoe press.

The pressing represented by the pressure profile of FIG. 3 essentially correlates to that of FIG. 2, except for the respective third press zones. Whereas the third press zone for the FIG. 2 device is provided by a press roll, the device of FIG. 3 has a third press zone formed by a shoe press, with a pressing 3' and a press zone length $L_{3S}$. Because of this, the FIG. 3 device also attains a gentle draining in the third nip at a simultaneously high total press impulse.

Even with this FIG. 3 press device, the K value ($K=L_{1S} \cdot I_{tot}$) is greater than 2.5 kPa·s·m, so that an optimal treatment, of graphic papers having a surface weight under 100 g/m2, is possible at high velocities.

Figure 4:
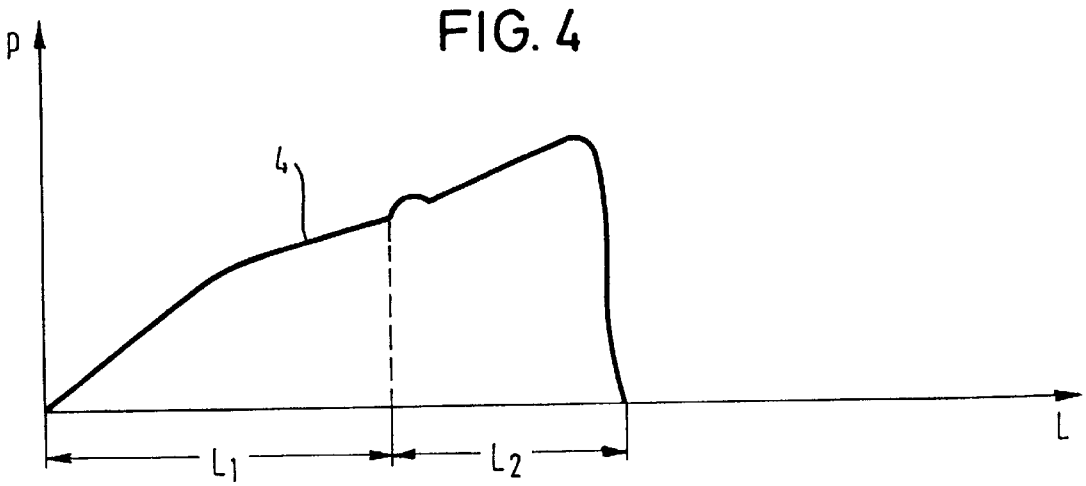
FIG. 4 is a graph showing the pressure profile, over the length of the press area, for a press device which employs, as the sole press mechanism, a shoe press of more than about 300 mm in length, as measured along the direction in which the web runs.

FIG. 4 depicts the pressure profile 4, of a press device in which both of the press zones, having lengths $L_1$ and $L_2$ respectively, are formed by one long shoe press—i.e., a shoe press which is more than about 300 mm in length, as measured along the direction in which the web runs. The length $L_1$ of the first press zone thereby extends from the beginning of the pressure profile to the point at which the increase of the pressure profile is at maximum, and thus defined, for example, by the position of the pressure profile turning point. The initial increase of the pressure profile is not taken into consideration here, because only a structural compression, without draining, occurs in this area.

The pressure profile illustrated in FIG. 4 essentially correlates to the pressure profile shown in FIG. 3, if the three nips forming the FIG. 3 pressure profile were concentrated into a single nip. For the FIG. 4 press device, the K value ($K=L_1 \cdot I_{tot}$) lies above the requisite 2.5 kPa·s·m lower limit.

Figure 5:
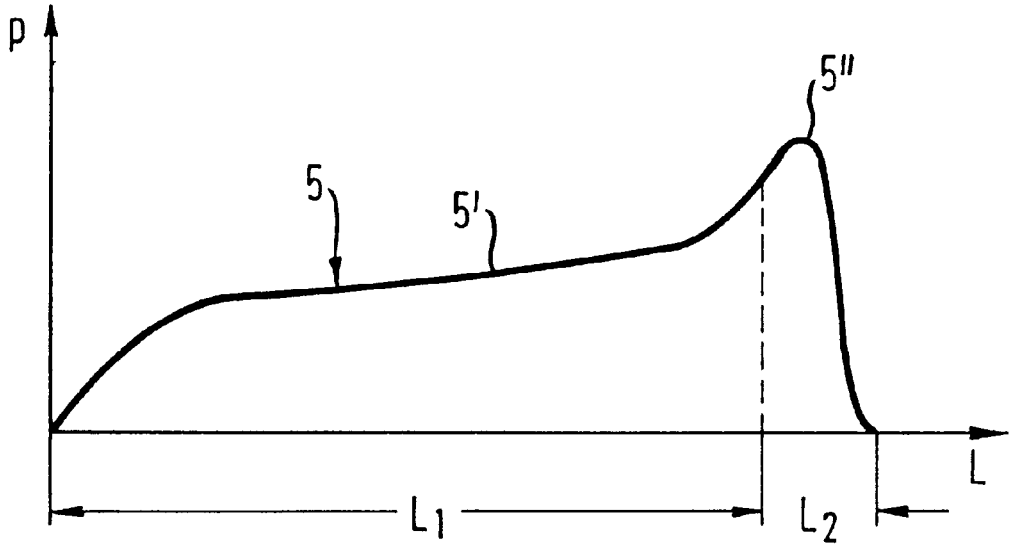
FIG. 5 is a graph showing the pressure profile, over the length of the press area, for a press device which employs an extended nip press as the sole press mechanism.

FIG. 5 shows the pressure profile 5 of a press device having two press zones with lengths $L_1$ and $L_2$, respectively. These zones are formed by one extended nip press, with the length $L_1$ being characterized by the turning point of the pressure profile 5. While in the first press zone of the press area a relatively gentle increase of the pressure occurs along the pressure profile 5', the pressure increases decidedly more sharply in the second press zone along the pressure profile 5". Through this, a gentle draining is attained at the beginning of the pressure profile, on the one hand, whereby simultaneously at the end of the pressing, the remaining moisture is pressed out of the fibrous pulp web by means of the increased pressure as well as the heightened gradient of the pressure profile.

The K value ($K=L_1 \cdot I_{tot}$) lies above the essential 2.5 kPa·s·m lower limit with this FIG. 5 press device also.

Figure 6:
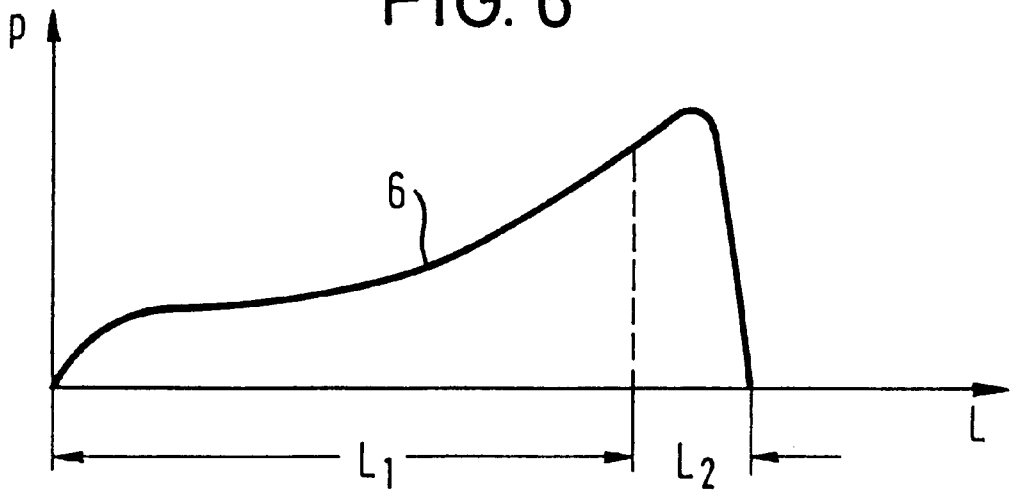
FIG. 6 is a graph showing the pressure profile, over the length of the press area, for another press device which employs an extended nip press as the sole press mechanism.

The pressure profile 6 shown of FIG. 6 is distinguished from the pressure profile illustrated in FIG. 5 in that, for the FIG. 6 pressure profile, the increase of the pressure within the first press zone runs more steeply than in pressure profile of FIG. 5. As with length $L_1$ for the first press zone in FIG. 5, the length $L_1$ of the FIG. 6 first press zone is correspondingly characterized by the turning point of the pressure profile 6. At the end of the pressing, the pressure inside of the second press zone decreases abruptly.

Even with the press device of FIG. 6, the K value lies above 2.5 kPa·s·m, so that qualitatively high-grade, graphic papers can be treated by this device at high velocities.

The press devices of FIGS. 2 and 3 each includes three press mechanisms, and therefore both of these devices have three nips. Each of the press devices of FIGS. 4, 5, and 6 employs a single press mechanism, and therefore these devices all have only one nip. Because of this single nip feature these latter press devices enjoy an advantage in efficiency over the FIG. 2 and FIG. 3 multiple nip devices.

In this regard, it is noted that the pressing which takes place with each press mechanism involves at least two steps. The first of these steps is structural compression; as indicated herein, with structural compression the web is compressed, but no draining, or dewatering, occurs. After a certain level of pressure is reached, the second step takes place, and draining occurs along with the compression.

After the pressure applied by the press mechanism reaches its apogee and begins falls back to zero, rewetting of the web occurs. And where there are multiple press mechanisms in the press device, efficiency is weakened for the following reasons.

Specifically, after pressure has fallen back to zero for the first press mechanism and the accompanying rewetting has occurred, pressure is applied by the next press mechanism, and the two or more step process is accordingly reiterated. The first step, as discussed, is the structural compression, and the corresponding lack of draining with this step is indicative of its inefficiency. As yet an additional inefficiency, at the point in this next mechanism's pressure profile where its pressure falls below the pressure at which draining occurs with the prior press mechanism, rewetting takes place again.

Both of these forms of inefficiency are repeated with each additional press mechanism. Accordingly, with multiple nips effective press length is lost from the press device.

However, with the single press mechanism devices, such as those of FIGS. 4, 5, and 6, there is no structural compression, without draining, to occur between nips, because there are no multiple nips; there is only the one nip for the device. Also, rewetting between press zones is practically nonexistent.

Accordingly, the two indicated forms of inefficiency which characterize multiple mechanism press devices are not found, or are greatly reduced, for the single nip press devices. These devices have increased effective press length.

It is noted that the foregoing examples have been provided merely for the purpose of explanation and are in no way to be construed as limiting of the present invention. While the invention has been described with reference to preferred embodiments, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed:

1. A process for pressing a fibrous pulp web having a surface weight of less than about 100 g/m$^2$, the process comprising:

(a) feeding the fibrous pulp web through a press area, comprising at least one press nip, at a velocity of at least about 1800 n/min, and simultaneously applying pressure to the fibrous pulp web, wherein the press area is composed of at least a first press zone and a second press zone successively arranged; and (b) successively pressing the fibrous pulp web in two or more successive press zones that include the first press zone and the second press zone of the press area, wherein a shoe press of more than about 500 mm in length, as measured along the direction in which the web runs is arranged to press the fibrous pulp web and form at least the first press zone;

whereby the pressing process of (a) and (b) has a K value of at least about 2.5 kPa·s·m, with the K value being the product of $L_1$ and $I_{tot}$, in which $L_1$ represents a length of the first press zone as measured along the direction in which the web runs, and $I_{tot}$ represents a total press impulse operating on the fibrous pulp web in an entirety of the press area;

and wherein the product of $L_1$ and $I_{tot}$ is defined by the equation $$L_1 \cdot I_{tot} = L_1 \cdot \frac{\sum_{i=1}^{n} (p_{m_i} \cdot L_i)}{v} = t_1 \cdot \sum_{i=1}^{n} \overline{p}_i$$

wherein:

n=the number of press zones;

$L_i$=the length of the I-th press zone;

$p_{m_i}$=the medium pressure applied to the fibrous pulp web in the I-th press zone;

v=the velocity of the fibrous pulp web;

$t_1$=the time that a point of the fibrous pulp web resides in the first press zone; and $\overline{p}_i$=the line force applied to the fibrous pulp web in the I-th press zone.

2. The process of claim 1 wherein at least two of the two or more successive press zones have differing pressure profiles.

3. The process of claim 1 wherein the K value is at least about 2.6 kPa·s·m.

4. The process of claim 1 wherein the K value is at least about 2.8 kPa·s·m.

5. The process of claim 1 wherein the K value is at least about 3.0 kPa·s·m.

6. The process of claim 1 wherein the two or more successive press zones are formed by multiple press mechanisms, comprising members selected from the group consisting of shoe presses, roll presses, and extended nip presses.

7. The process of claim 1 wherein the first press zone is formed by a shoe press.

8. The process of claim 7 wherein the second press zone is formed by a member selected from the group consisting of a shoe press and a roll press.

9. The process of claim 8 wherein the two or more successive press zones comprise the second press zone and a third press zone, formed by successive roll presses.

10. The process of claim 1 wherein the two or more successive press zones comprise the first press zone formed by a first shoe press, the second press zone formed by a roll press successive to the first shoe press, and a third press zone formed by a second shoe press successive to the roll press.

11. The process of claim 1 wherein the two or more successive press zones consist of two successive press zones, the two successive press zones consisting of the first press zone formed by a shoe press and the second press zone formed by a different shoe press, the two shoe presses being arranged successively in the direction that the fibrous pulp web runs.

12. The process of claim 11 wherein the two shoe presses have at least substantially the same mechanical configuration.

13. The process of claim 12 wherein the line forces $\overline{p}_1$ and $\overline{p}_2$ of the two press zones are at least substantially equal, and the lengths $L_{1S}$ and $L_{2S}$ of the press zones, as measured along the direction in which the web runs, are not equal.

14. The process of claim 12 wherein the line forces $\overline{p}_1$ and $\overline{p}_2$ of the two press zones are not equal, and the lengths $L_{1S}$ and $L_{2S}$ of the press zones, as measured along the direction in which the web runs, are at least substantially equal.

15. The process of claim 12 wherein the line forces $\overline{p}_1$ and $\overline{p}_2$ of the two press zones are not equal, and the lengths $L_{1S}$ and $L_{2S}$ of the press zones, as measured along the direction in which the web runs, are not equal.

16. The process of claim 12 wherein the line forces $\overline{p}_1$ and $\overline{p}_2$ of the two press zones are at least substantially equal, and the lengths $L_{1S}$ and $L_{2S}$ of the press zones, as measured along the direction in which the web runs, are at least substantially equal.

17. The process of claim 11 wherein the two or more successive press zones further comprise, after the second press zone, a press zone formed by a roll press, arranged successively with the two shoe presses in the direction that the fibrous pulp web runs.

18. The process of claim 1 wherein the two or more successive press zones are formed by a single press mechanism.

19. The process of claim 18 wherein the single press mechanism is an extended nip press.

20. The process of claim 1 wherein the total length $$L_{tot} = \sum_{i=1}^{n} L_i$$

of the press area is at least about 250 mm.

21. The process of claim 1 wherein the total time $$t_{tot} = \sum_{i=1}^{n}$$

$t_i$ that a point of the fibrous pulp web resides in the press area is at least about 10 milliseconds.

22. The process of claim 1 wherein the total line force operating in the press area $$\overline{p}_{tot} = \sum_{i=1}^{n} \overline{p}_i$$

is about 1800 kN/m or less.

23. The process of claim 1 wherein the total press impulse $I_{tot}$ operating on the fibrous pulp web is at least about 25 kPa's.

24. The process of claim 1 wherein the characteristic number for the draining capacity $DC=\overline{p}_{tot}\cdot t_{tot}$ is at least about 15

$$\frac{kN \cdot s}{m}.$$

25. The process of claim 1 wherein the characteristic number for gentle draining $$GD = \frac{\overline{p}_{tot}}{t_{tot}}$$

about 63

$$\frac{MN}{m \cdot s}$$

or less.

26. The process of claim 1 comprising applying a lower pressure to the fibrous pulp web in the first press zone than in any subsequent press zone.

27. The process of claim 1 wherein, in the portion of the pressure profiles indicating increasing pressure, the pressure profile in the first press zone has a pressure gradient lower than that of the pressure profile for at least one subsequent press zone.

28. The process of claim 1 wherein at least two successive press zones are formed by shoe presses alternatingly arranged, on opposed sides of the fibrous pulp web.

29. A process for pressing a fibrous pulp web having a surface weight of less than about 100 g/m$^2$, the process comprising:

(a) feeding the fibrous pulp web through a press area, comprising at least one press nip, at a velocity of at least about 1800 m/min, and simultaneously applying pressure to the fibrous pulp web, wherein the press area is composed of at least a first press zone and a second press zone successively arranged; and (b) successively pressing the fibrous pulp web in two or more successive press zones that include the first press zone and the second press zone of the press area, wherein a shoe press of more than about 500 mm in length, as measured along the direction in which the web runs is arranged to press the fibrous pulp web and form at least the first press zone;

whereby the pressing process of (a) and (b) has a K value of at least about 2.5 kPa·s·m, with the K value being the product of $L_1$ and $I_{tot}$, in which $L_1$ represents a length of the first press zone as measured along the direction in which the web runs and wherein the total length $$L_{tot} = \sum_{i=1}^{n} L_i$$

of the first press area is at least about 250 mm, and $I_{tot}$ represents a total press impulse operating on the fibrous pulp web in an entirety of the press area of the process;

wherein the product of $L_1$ and $I_{tot}$ is defined by the equation $$L_1 \cdot I_{tot} = L_1 \cdot \frac{\sum_{i=1}^{n} (p_{m_i} \cdot L_i)}{v} = t_1 \cdot \sum_{i=1}^{n} \overline{p}_i$$

wherein:

n=the number of press zones;

$L_i$=the length of the I-th press zone;

$p_{m_i}$=the medium pressure applied to the fibrous pulp web in the I-th press zone;

v=the velocity of the fibrous pulp web;

$t_1$=the time that a point of the fibrous pulp web resides in the first press zone; and $\overline{p}_i$=the line force applied to the fibrous pulp web in the I-th press zone.

30. A process for pressing a fibrous pulp web having a surface weight of less than about 100 g/m$^2$ in a press area including a single press nip having at least a first press zone and a second press zone successively arranged, the process comprising:

(a) feeding the fibrous pulp web through a press area at a velocity of at least about 1800 m/min, and simultaneously applying pressure to the fibrous pulp web; and (b) successively pressing the fibrous pulp web in two or more successive press zones that include the first press zone and the second press zone of the press area, wherein a shoe press of more than about 500 mm in length, as measured along the direction in which the web runs is arranged to press the fibrous pulp web and form at least the single press nip;

whereby the pressing process of (a) and (b) has a K value of at least about 2.5 kPa·s·m, with the K value being the product of $L_1$ and $I_{tot}$, in which $L_1$ represents a length of the first press zone as measured along the direction in which the web runs, and $I_{tot}$ represents a total press impulse operating on the fibrous pulp web in the entire press area of the process;

wherein the product of $L_1$ and $I_{tot}$ is defined by the equation $$L_1 \cdot I_{tot} = L_1 \cdot \frac{\sum_{i=1}^{n} (p_{m_i} \cdot L_i)}{v} = t_1 \cdot \sum_{i=1}^{n} \overline{p}_i$$

wherein:

n=the number of press zones;

$L_i$=the length of the I-th press zone;

$p_{m_i}$=the medium pressure applied to the fibrous pulp web in the I-th press zone;

v=the velocity of the fibrous pulp web;

$t_1$=the time that a point of the fibrous pulp web resides in the first press zone; and $\overline{p}_i$=the line force applied to the fibrous pulp web in the I-th press zone.

* * * * *